United States Patent [19]

Takahashi

[11] 4,118,096

[45] Oct. 3, 1978

[54] CONNECTING MEANS FOR FLEXIBLE FLAT CABLE CONNECTOR

[75] Inventor: Toru Takahashi, Yokohama, Japan

[73] Assignee: Yamaichi Electric Mfg. Co., Ltd., Tokyo, Japan

[21] Appl. No.: 765,001

[22] Filed: Feb. 2, 1977

[30] Foreign Application Priority Data

Feb. 14, 1976 [JP] Japan ..... 51-14411

[51] Int. Cl.[2] ..... H01R 13/38

[52] U.S. Cl. ..... 339/99 R

[58] Field of Search ..... 339/97 R, 97 P, 99 R

[56] References Cited

U.S. PATENT DOCUMENTS

| | | | |
|---|---|---|---|
| 3,820,055 | 6/1974 | Huffnagle et al. | 339/97 P |
| 3,820,058 | 6/1974 | Friend | 339/99 R |

FOREIGN PATENT DOCUMENTS

| | | | |
|---|---|---|---|
| 2,305,040 | 10/1976 | Fed. Rep. of Germany | 339/258 R |

*Primary Examiner*—Joseph H. McGlynn

*Attorney, Agent, or Firm*—Wenderoth, Lind & Ponack

[57] ABSTRACT

This invention relates to connecting members in a connector for use in connecting respective conductors in flexible flat cables. These connecting members have a slit in a crotch shaped structure to impart greater flexibility to the member. In addition the connecting members employ two pairs of offset tines to form a better connection with stranded cables.

5 Claims, 11 Drawing Figures

CONNECTING MEANS FOR FLEXIBLE FLAT CABLE CONNECTOR

BACKGROUND OF THE INVENTION

This invention relates to a connecting means for use in an electrical connector for making electrical contact to multi-conductor flexible flat cable.

The above-mentioned flexible flat cable is a relatively recent development, and is utilized in making electrical connections in electronic circuits. In such use, said cable is required to be provided, at the extremities thereof, with a terminal member maintained in permanent electrical contact with the conductors contained in the cable.

The contactor known in the prior art and used for the above-mentioned purpose is punch formed from a relatively thin metal plate of a suitable hardness and tenacity such as beryllium copper or phosphor bronze and provided with a U-shaped pair of sharply pointed tines, which pierce the insulator of said flexible flat cable to expose the conductor therein and firmly hold the thus exposed conductor by the side walls of a U-shaped crotch to form a permanent electrical contact.

Such a connecting method, however, has a serious drawback. Although the above-mentioned method does not result in a particular problem in the case where each conductor in said flexible flat cable is composed of a single wire, the conductor, if composed of a stranded structure of a plurality of thin wires, is apt to be deformed when pressed into the U-shaped crotch of the tines, to a shape easily accomodatable in said crotch. Such deformed stranded structure results in a lowered holding pressure of the contactor against the conductor after insertion thereof and eventually leads to losing electrical contact after prolonged use.

In order to avoid this difficulty to the contacting force may be increased by pressing the conductor in the cable down to the bottom of the U-shaped crotch and thus concentrating the wires of deformed stranded structure forcedly into a determined position. However, in order that the inserted conductor can be accomodated in the bottom of the U-shaped crotch, this bottom portion must be provided with suitable elasticity. Otherwise, the forced insertion of the conductor into said bottom will either result in the breakage of the stranded thin wires of the conductor or result in a permanent distortion of the U-shaped contactor, thus seriously affecting the electrical connecting properties.

SUMMARY OF THE INVENTION

The present invention provides, in consideration of the aforementioned status of the prior art, a connecting means not only avoiding the drawbacks and limitations in the conventional technology but also achieving an extremely high reliability.

The principal object of the present invention is to provide a connecting means consisting of two pairs or four electrical contact tines wherein the two tines of each pair are mutually displaced front and back so as to be positioned in two different planes.

Another object of the present invention is to provide a connecting means constituting an U-shaped crotch provided with a conductor accomodating bottom composed of two pairs of tines wherein the two tines in each pair are positioned in different planes as aforementioned, whereby the conductor inserted into said U-shaped crotch is laterally alternately pressed by said two pairs of tines thereby realizing a secured electrical connection between the conductor and each tine with a mechanical strength sufficiently strong for resisting eventual external tension.

A further object of the present invention is to provide a connecting means as aforementioned wherein the two tines in each pair are positioned so as to be effective for unstranding the stranded structure of wires thereby concentrating the stranded wires into the U-shaped crotch and realizing secured insertion of the wires thereinto.

A still further object of the present invention is to provide a connecting means as aforementioned wherein the bottom of said U-shaped crotch is provided with a vertical slit in order to furnish that bottom portion with an elasticity thereby enabling satisfactory accomodation of the conductor in the crotch and simultaneously effectively preventing the permanent distortion of contactor or incomplete connection resulting from insertion of the conductor.

A still further object of the present invention is to provide a connecting means provided with tines structured so as to be capable of satisfactorily piercing the insulating layer of a cable containing parallel conductors therein to expose the conductors and also capable of elevating the pressure on the inserted conductor in the crotch formed by said tines to achieve a permanent electrical connection.

A still further object of the present invention is to provide a connecting means of a simple and still highly reliable structure easily obtainable by simply applying folding or bending operations on a punched single metal plate.

The other advantages and features of the present invention will be explained in detail in the following description, while referring to the attached drawings.

DESCRIPTION OF THE PREFERRED EMBODIMENTS

Figure 1:
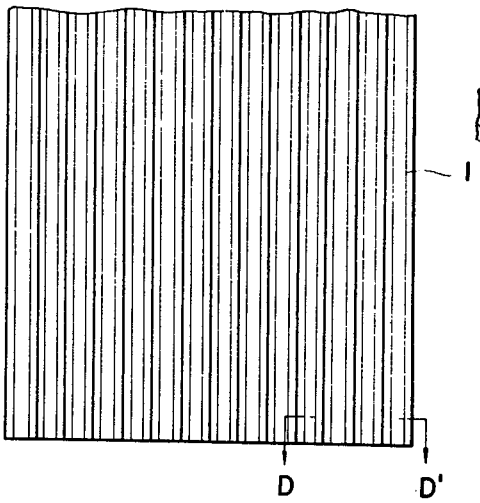
FIG. 1 is a plan view of a flexible flat cable.
Figure 2:
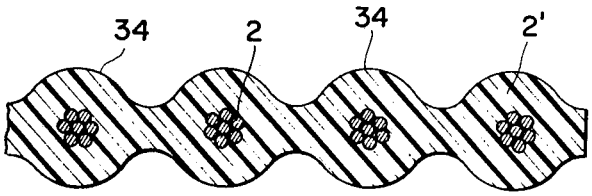
FIG. 2 is a cross-sectional view of said flat cable along a line D—D′ in FIG. 1.

Now referring to FIGS. 1 and 2, a flexible flat cable 1 is provided with a plurality of parallel condoctors 2 maintained in a common plane with a fixed distance therebetween by means of an insulating material 2' such as a plastic. Each of the conductors 2 may be composed either of a single wire or of a stranded group of wires, but the description in the present specification will be given with reference to a flat cable with conductors of a stranded structure as illustrated.

Figure 3:
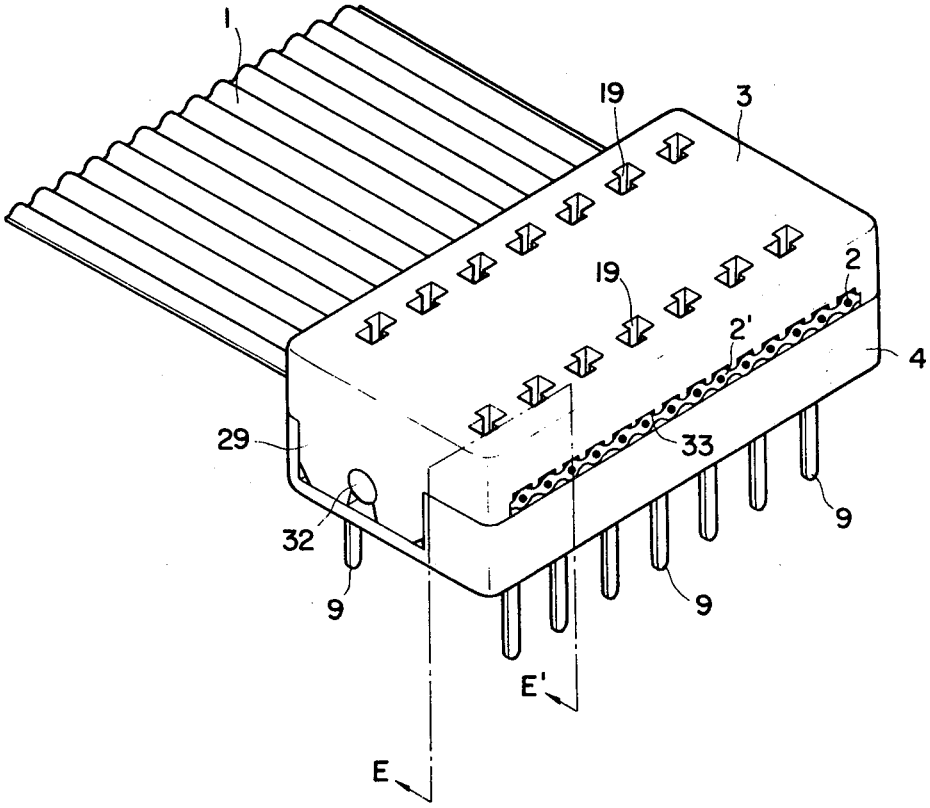
FIG. 3 is a perspective view of a connector of the present invention mounted on a flexible flat cable.
Figure 4:
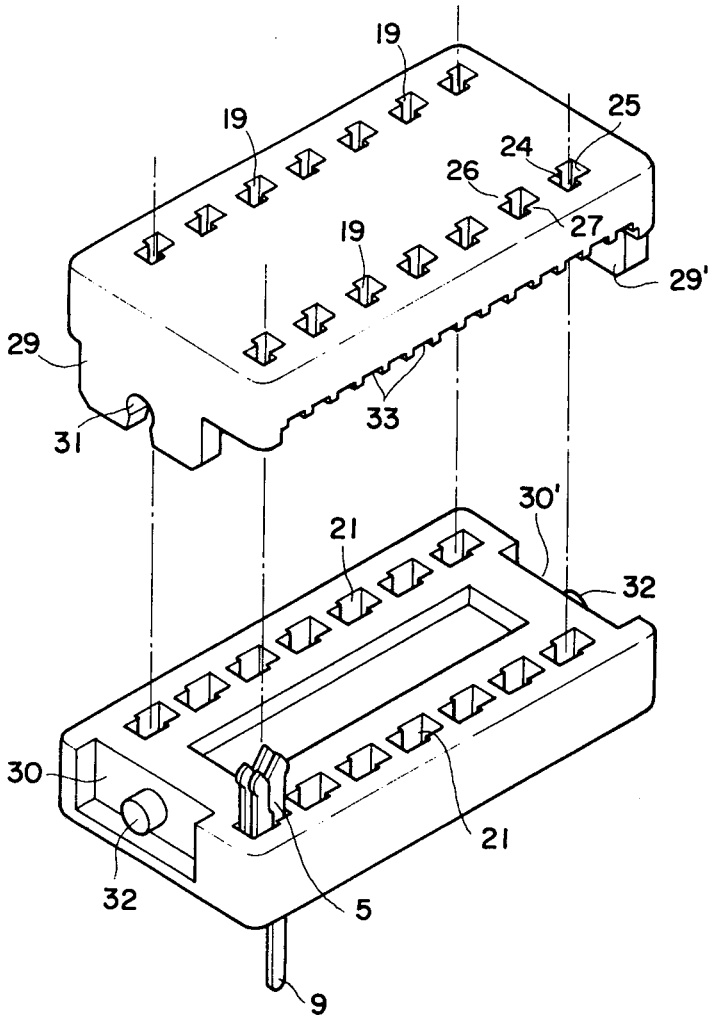
FIG. 4 is a perspective view of the connector of the present invention illustrating the base plate portion and the cover portion thereof in a dismantled state.
Figure 5:
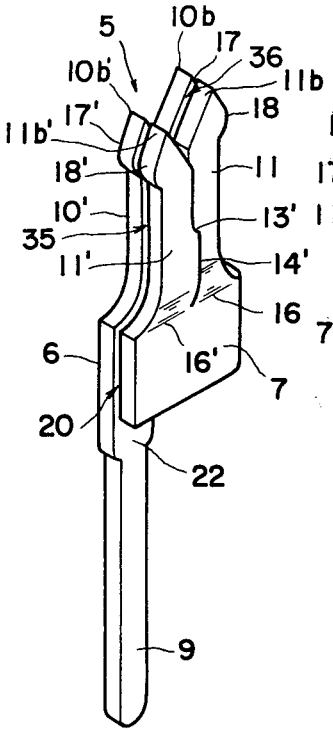
FIG. 5 is a perspective view of a contactor of the present invention.
Figure 6:
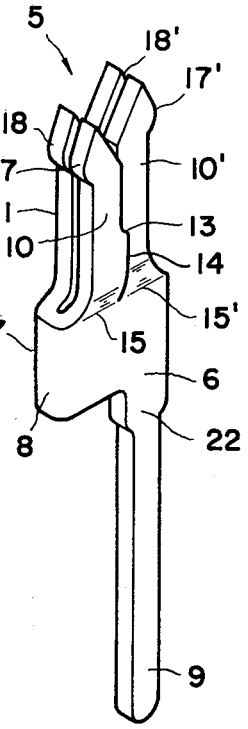
FIG. 6 is a perspective view of the contactor showing the opposite side thereof.
Figure 7:
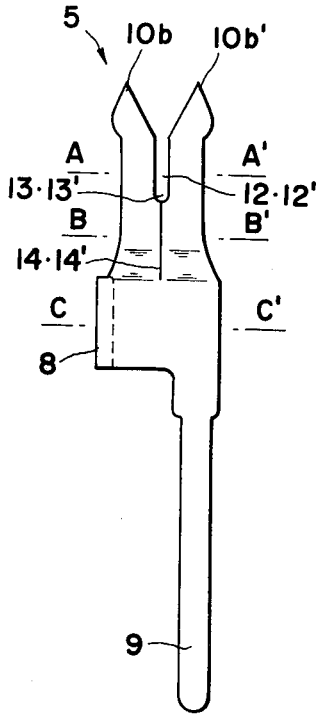
FIG. 7 is an elevational view of the contactor of the present invention.
Figure 8:
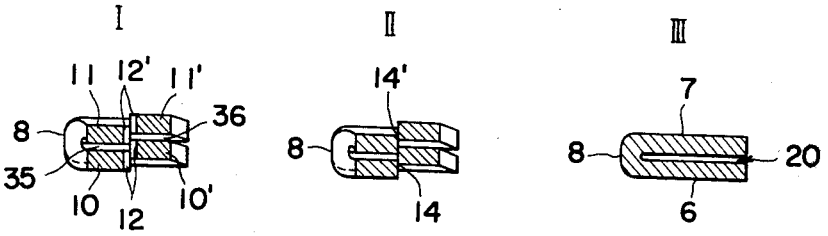
FIG. 8 (I), (II), (III) are cross-sectional views along the line A—A′, B—B′ and C—C′ in FIG. 7, respectively.
Figure 9:
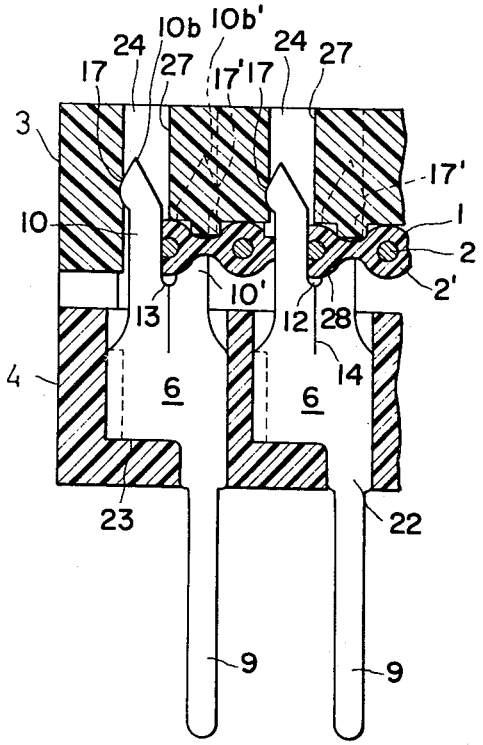
FIG. 9 is a cross-sectional view along the line E—E′ in FIG. 3 illustrating an initial state of insertion of the conductor of the cable into the U-shaped crotch of the contactor by means of a part of the connector base plate portion and a part of the cover portion.
Figure 10:
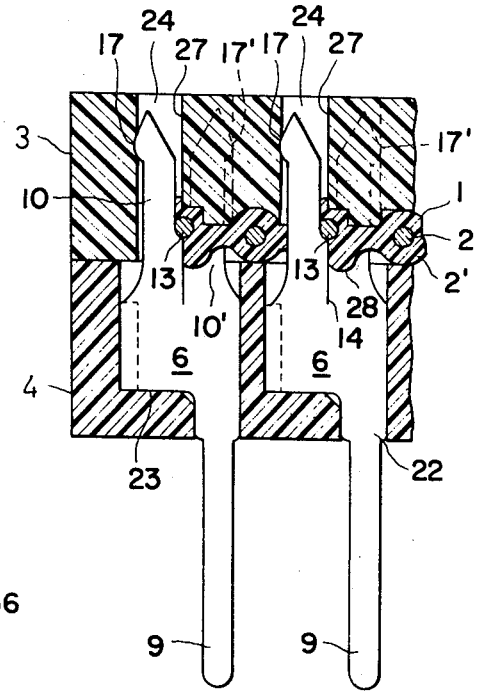
FIG. 10 is a cross-sectional view along the line E—E′ illustrating a final state of insertion of the conductor following the state of FIG. 9.

The connector of the present invention is composed, as shown in FIGS. 3 and 4, of a cover portion 3 and a base plate portion 4, wherein said base plate portion 4 is provided with a plurality of electrical connecting terminals or contactors 5 arranged in two parallel rows, while said cover portion 3 is provided with a plurality of contactor inserting openings 19 corresponding thereto. As shown in FIGS. 5, 6, 7 and 8, each electrical contact terminal 5 is provided with two planar plate portions 6, 7 provided in a parallel arrangement with a gap 20 therebetween and mutually connected by means of a folding portion 8, wherein either one of these planar plate portions, for example 6, is provided with a downwards extended wiring terminal portion 9 which is to be soldered to an electroconductive portion or inserted into a female connector or the like of a pinted circuit board. Further said planar plate portion 6 is provided with a laterally positioned pair of contact tines 10 and 10', while the planar plate portion 7 is also provided with a laterally positioned pair of contact tines 11 and 11', said tines in each pair being extended upwards with a spacing therebetween to constitute an U-shaped crotch 12 or 12', respectively, into which the cable conductor 2 is to be pressed. The U-shaped crotches 12 and 12' are structured open at the upper extremity thereof to facilitate the insertion of the cable conductor 2 thereinto. Further, as shown in FIGS. 5 to 9, the tines 10 and 10' are divided by very narrow slits 14 and 14' which extend downwards from the U-shaped crotches 12 and 12'. The very narrow slits 14 and 14' do not receive the cable conductor 2 thereinto and act only to furnish each paired tines 10 and 10', and 11 and 11' with elasticity. Between the crotches 12 and 12' and the narrow slits 14 and 14', i.e., bottom portions 13 and 13' of the crotches 12 and 12' are rounded as shown in FIGS. 7 and 9 to accomodate the cable conductor 2 and further to prevent the conductor 2 from entering into the slits 14 and 14'. Furthermore, the tines in each pair, 10 and 10' or 11 and 11', are respectively displaced front and back with respect to the connecting portions 15 and 15' or 16 and 16' of the corresponding planar plate portion 6 or 7 thus to lie in two different planes, so as forming a staggered arrangement of said tines 10, 10', 11 and 11'. Said tines 10, 10', 11 and 11' are respectively provided, at the upper extremities thereof, with externally projecting portions 17, 17', 18 and 18' which are bent outwardly by the spring action of the tines and by means of the wedge effect of the cable conductor 2 when it is pressed into the U-shaped crotches 12 and 12', to impinge on the side walls of the openings 19 of cover portion 3. Without these side walls, the tines in each pair 10 and 10' or 11 and 11' will undergo a larger deformation beyond the position of the side walls, thus resulting in an expansion of the U-shaped crotch 12 or 12' and an inability to apply a sufficient contacting force on the inserted cable conductor 2. According to the present invention the projecting portions 17 and 17' or 18 and 18' are suitably supported by the side walls of the openings 19 thereby elevating the pressure applied on the cable conductor 2 and enabling permanent electrical contact. Each upper extremity of the tines 10, 10', 11 and 11' is contoured by the inclined edge of the opening of U-shaped crotch 12 or 12' and another inclined edge leading to said projecting portions 17, 17', 18 or 18' to form a sharply pointed end **10*b*, 10*b'*, 11*b* or 11*b'* which is utilized to pierce the cable insulation 2' in the assembly step to expose the cable conductor 2 and to form an active contact surface between the side walls of said U-shaped crotch 12 and 12' and the cable conductor 2. The inclined edges leading to the projecting portion help to guide the pointed end into the opening 19** at the assembly step.

The two planar plate portions 6 and 7 are required to be interspaced so as to allow a staggered arrangement of the tines 10, 10', 11 and 11'. In a most preferred embodiment the planar plate portions 6 and 7 are interspaced by a distance not exceeding the thickness of the plate used for the contactor, and the tines are displaced forward and backward at the respective connecting portions 15, 15', 16 and 16' by a distance not exceeding half of this thickness thereby achieving a staggered arrangement in each pair of tines 10, which therefore lie in two different planes which are parallel to each other, as shown in FIG. 8. As shown in further detail in FIG. 8 II, the stagger between each pair of tines starts from the base portions of the tines which are divided by the narrow slits 14 and 14'. The partial stagger is the same as shown in FIG. 8 I, at the top portions of the tines which are divided by the U-shaped crotches 12 and 12'.

The contact terminals 5 are mounted respectively in the openings 21 provided on the base plate 4 by inserting the wiring terminal portions 9 thereinto. These openings 21 are arranged along the transversal direction of the cable and in one or more rows so as to correspond to the distance of the conductors in the cable. These openings 21 are preferably dimensioned so as to accomodate the base part 22 of terminal portion 9 of the contact terminal 5 in snug contact. Also these openings 21 are required to be structured wide enough to accomodate the contact terminals 5 up to the upper part of connecting portions 15 and 15' or 16 and 16' thereof without causing any change in the arrangement of tines 10 and 10' or 11 and 11' and still narrow enough so as not to allow swaying of the contact terminals after mounting. Further, the openings 21 are respectively provided with a shoulder 23 separating the upper part thereof accomodating the planar plate portions 6, 7 of the contact terminals 5 and the lower part accomodating the terminal portion thereof.

The cover part 3 is provided with aforementioned openings 19 passing through from the upper surface to the lower surface thereof. These openings 19 are provided corresponding to the arrangement of the conductors 2 in the cable and also to the positions of the U-shaped crotches of the contactors 5 mounted in the openings 21, and located so as to accomodate the tines 10, 10', 11 and 11' in a position when said tines have pierced the cable. Each opening 19 is divided into an opening portion 24 for accomodating the projecting portions 17 and 18 of tines of contactor 5 and an another opening portion 25 for accomodating the projecting portions 17' and 18' of the tines of said contactor 5, these portions being mutually connected in a staggered relationship corresponding to the positions of tines accomodated therein. The staggered portions 26 and 27 (see FIG. 4) of the openings 19 are positioned so as to face the side walls of U-shaped crotches 12 and 12' of the tines 10 and 11 and perform a function, when pressing the cable conductors 2 into the U-shaped crotch 12, of pressing the upper surface of the insulator of the cable thereby squeezing the cable conductor 2 into the bottom portions 13 and 13' of U-shaped crotches and pressing the insulator 28 of the cable further from said bottom portions 13 and 13' to the slits 14, 14' of the contactors to form a fresh contact surface between the cable conductor 2 and said bottom portions 13 and 13'.

The cover part 3 is provided on both ends thereof with lock mechanisms 29 and 29' which engage with the recesses 30 and 30' provided on both ends of the base plate part 4. In this case an engaging recess 31 of this lock mechanism of the cover part 3 engages with an engaging pin 32 provided on the base plate part 4, to form a connection between the two parts. The lock mechanisms 29 and 29' of the cover part 3 are mutually spaced so as to be adapted to the width of the cable 1 thereby placing said cable in a determined position at the assembly of the connector.

The recesses 33 provided inside the cover part 3 are designed to engage with the irregular periphery 34 of the cable thereby positioning the conductors 2 thereof in the correct positions.

According to the present invention the conductor 2 of the cable 1 is introduced, in order to prevent the deformation of the stranded structure thereof, down to the bottom 13 and 13' of the U-shaped crotches 12 and 12' thereby concentrating the thin wires of stranded conductor into a fixed position to elevate the contact force with the contactor 5. Also there are provided slits 14 and 14' at the bottom of said U-shaped crotches 12 and 12' to provide elasticity thereby preventing the permanent deformation of said crotches 12 and 12' and the breakage of the thin wires of the stranded conductor to ensure permanent contact pressure. In order to prevent the eventual interposition of the insulator 2' between the bottom portion 13 and 13' and the conductor 2 in case of pressing the stranded wires against the bottom portion 13 and 13', two pairs of tines 10, 10', 11 and 11' of the U-shaped crotches are arranged in a staggered arrangement thereby extruding the insulator 2' from the bottom portions 13 and 13' and realizing a firm close contact between the bottom portions and the conductor 2.

In a staggered arrangement wherein the two tines 10 and 11 provided front and back with a spacing 35 therebetween are located not coplanar with the other tines 10' and 11' similarly provided front and back with a spacing 36 therebetween, it is preferable to maintain said spacings 35 and 36 smaller than the thickness of metal plate constituting the tines in such a manner that the internal faces **10*a* and 10*a'* or 11*a* and 11*a'* constituting each U-shaped crotch 12 or 12' are in a partially facing relationship, as such arrangement not only reduces the total thickness of the terminal but also effectively prevents the unstranding of the conductor or the incomplete electrical contact resulting from breakage of stranded wires when the stranded wires are pressed into the crotches 12 and 12'**.

Figure 11:
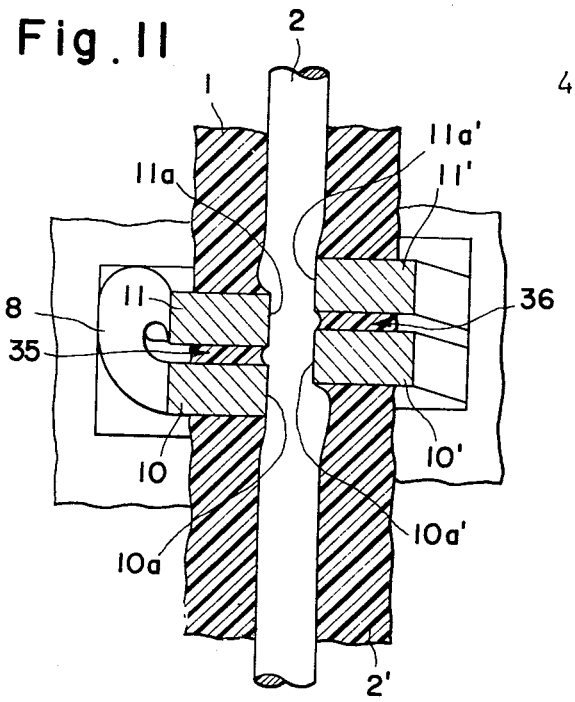
FIG. 11 is a partial cross-sectional view of FIG. 10 illustrating the cross-sectional state of the pointed tines contacting the inserted conductor.

In the case of pressing the conductor 2 into the U-shaped crotches 12 and 12' composed of two pairs of tines in the aforementioned partially facing staggered arrangement, as shown in FIG. 11, the conductor 2 is laterally pressed in opposite directions by the internal faces **10*a* and 11*a'* of the outside tines and again pulled by the internal faces 10*a'* and 11*a* of the inside tines to form alternate bendings, thereby realizing an alternate engagement with said tines. As a result there is exposed an active surface of conductor with which said tines 10, 10', 11 and 11' are maintained in intimate air-tight contact. In consequence there is formed a mutual diffusion of metal texture at the contact surface to form an alloy state, thus assuring a satisfactory electrical contact. The breakage of wires is also prevented due to the fact that the corners of each paired tines 10 and 10' or 11 and 11'** are located in a staggered arrangement.

Furthermore, due to the use of two pairs of tines 10 and 10' and 11 and 11' in a staggered arrangement for holding the conductor 2 of a flexible flat cable, it is possible to press the conductor 2 down to the bottom portions 13 and 13' of U-shaped crotches 12 and 12' in a stable state, thus increasing the reliability and durability of electrical contact. A sufficiently large contact area is obtained even in a case of using the thin metal plate, since the electrical contact is performed by means of four faces.

What we claim is:

1. A connecting means for use in an electrical connector for making electrical contact with a multiconductor flexible flat cable comprising:

two pairs of contact tines, said tines in each pair joined at the lower ends thereof and separated by a U-shaped crotch adapted for accomodating one conductor of a multiconductor flexible flat cable and a narrow slit extending downwards from said U-shaped crotch and having a uniform width, the bottom of said slit being the bottom of the space between said tines, said U-shaped crotch having a bottom portion adapted for receiving one conductor of a multiconductor flexible flat cable and said slit having a width dimension less than that of the cable for preventing the conductor from entering into said narrow slit, each of said tines lying in different parallel planes offset in a direction perpendicular to the length of said tines whereby said two pairs of contact tines have a partially facing mutually staggered relationship.

2. A connecting means according to the claim 1 wherein each of said tines is provided with a projecting portion at the external end portion thereof and a sharply pointed end.

3. A connecting means according to the claim 1 wherein said two pairs of tines have a spacing therebetween smaller than the thickness of the material constituting said tines.

4. A connecting means according to the claim 1, further comprising two planar plate portions which are composed of an interspaced folded structure of a single plate wherein said two pairs of tines are respectively formed integral with and extended upwards from said two planar plate portions.

5. A connecting means according to the claim 4 wherein one of said two planar plate portions is provided with a downwardly extended connecting terminal portion.

* * * * *